US006732690B2

(12) United States Patent
Pierik et al.

(10) Patent No.: US 6,732,690 B2
(45) Date of Patent: May 11, 2004

(54) CAMSHAFT PHASER HAVING AN EXTERNAL BIAS SPRING

(75) Inventors: Ronald J. Pierik, Rochester, NY (US); Dominic Borraccia, Spencerport, NY (US); Jason Urckfitz, Brockport, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/421,397

(22) Filed: Apr. 23, 2003

(65) Prior Publication Data

US 2003/0217718 A1 Nov. 27, 2003

Related U.S. Application Data

(60) Provisional application No. 60/424,350, filed on Nov. 6, 2002, and provisional application No. 60/382,237, filed on May 21, 2002.

(51) Int. Cl.[7] ..... F01L 1/34

(52) U.S. Cl. ..... 123/90.17; 123/90.15; 464/160

(58) Field of Search ..... 123/90.15, 90.16, 123/90.17, 90.18, 90.27, 90.31, 90.65, 90.66, 90.67; 464/1, 2, 160; 74/568 R

(56) References Cited

U.S. PATENT DOCUMENTS 6,276,321 B1 * 8/2001 Lichti et al. ..... 123/90.17
6,619,248 B1 * 9/2003 Bertelshofer et al. .... 123/90.15
6,662,769 B2 * 12/2003 Eguchi et al. ..... 123/90.17

* cited by examiner

*Primary Examiner*—Thomas Denion
*Assistant Examiner*—Ching Chang
(74) *Attorney, Agent, or Firm*—Patrick M. Griffin

(57) ABSTRACT

A torque bias coil spring for a camshaft phaser disposed on the outside of a cover plate for the rotor chamber and connected between the stator and rotor for angularly biasing the rotor. A rotor extension, such as a sleeve for a locking pin mechanism or a target wheel unit, extends from the rotor chamber through an opening in the cover plate for engaging a first spring tang. The second tang of the spring is engaged by a phaser binder bolt. The spring thus is able to follow the rotary motion of the rotor within the rotor chamber and to bias the rotor toward a predetermined rotational extreme.

10 Claims, 9 Drawing Sheets

CAMSHAFT PHASER HAVING AN EXTERNAL BIAS SPRING

RELATIONSHIP TO OTHER APPLICATIONS AND PATENTS

This application claims priority from Provisional U.S. Patent Application, Serial No. 60/382,237, filed May 21, 2002 and from Provisional U.S. Patent Application, Serial No. 60/424,350, filed Nov. 6, 2002.

TECHNICAL FIELD

The present invention relates to a camshaft phaser for controlling the phase relationship between the crankshaft and a camshaft of an internal combustion engine; more particularly, to a vane-type phaser having a spring for biasing its rotor toward an extreme position; and most particularly, to a phaser wherein such a bias spring is disposed outside the rotor chamber for easy and reliable installation.

BACKGROUND OF THE INVENTION

Camshaft phasers for varying the phase relationship between the pistons and the valves of an internal combustion engine are well known. Some prior art camshaft phasers include a torque bias spring within the rotor chamber to bias the rotor at rest toward an extreme rotational position; see, for example, U.S. Pat. No. 6,276,321 B1. Typically, such a spring must be accommodated within a well within the rotor hub, thus limiting the maximum possible diameter of the spring. The spring design is further compromised by requiring the spring hooks to be a small radius when the main coils are at a larger radius, which results in undesirably high stress levels in the spring wire and potentially difficult manufacturing processes. Further, the spring may be damaged or mis-installed during assembly, and correct installation cannot be verified visually after the rotor chamber is closed by the cover plate.

What is needed is a spring arrangement wherein spring diameters greater than the rotor diameter are available to optimize design of a vane-type phaser, and wherein spring installation is simple and easily verified after the rotor chamber is closed.

It is a principal object of the present invention to provide an improved camshaft phaser wherein a rotor torque bias spring has a radius greater than the radius of the rotor hub such that the size of the spring may be optimized.

It is a further object of the present invention to provide a phaser having an optimized torque bias spring.

It is a still further object of the invention to provide a phaser wherein installation of a rotor torque bias spring during phaser assembly is both simple and easily verifiable after closure of the rotor chamber.

SUMMARY OF THE INVENTION

Briefly described, a torque bias coil spring for a camshaft phaser is disposed on the outside of a cover plate for the rotor chamber. A first and passive tang of the spring is engaged by a fixed first stop, for example, a phaser binder bolt on the periphery of the stator. A second stop connected to the rotor, for example, a locking pin mechanism (first embodiment) or a target wheel (second embodiment), extends from the rotor chamber through the cover plate for engaging a second and active tang of the spring. The spring thus is able to follow the rotary motion of the rotor within the phaser stator and to apply bias of the rotor toward a predetermined rotational extreme, for example fully advanced although the spring load can be sized to balance or favor one direction or the other. As the rotor is commanded toward the opposite extreme position by the phaser controller, the spring load increases, which decreases the rate of response in that direction but increases the rate of response in the opposite direction. The spring is easily and reliably mounted onto the first and second stops after the rotor chamber has been assembled and the cover plate is in place and bolted down. A significant advantage over prior art springs disposed within the rotor chamber is that, by properly selecting the radial locations of the first and second stops and the diameter of the coils, the bias spring may be significantly larger in diameter than the rotor hub, a substantial limitation of prior art cam phasers having internal bias springs.

Further, with an external bias spring in accordance with a second embodiment, a prior art die cast cover, a spacer, and two dowel pins can be eliminated. The die cast cover may be replaced by a simple stamped cover. The fixed end of the spring is hooked to a stator bolt, and the moving end is fixed to a target wheel mechanism which rotates with the rotor and camshaft. This arrangement not only eliminates or simplifies several components but also increases available space for the spring, permitting use of a more robust spring with a lower spring rate within the overall axial length of a prior art phaser.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
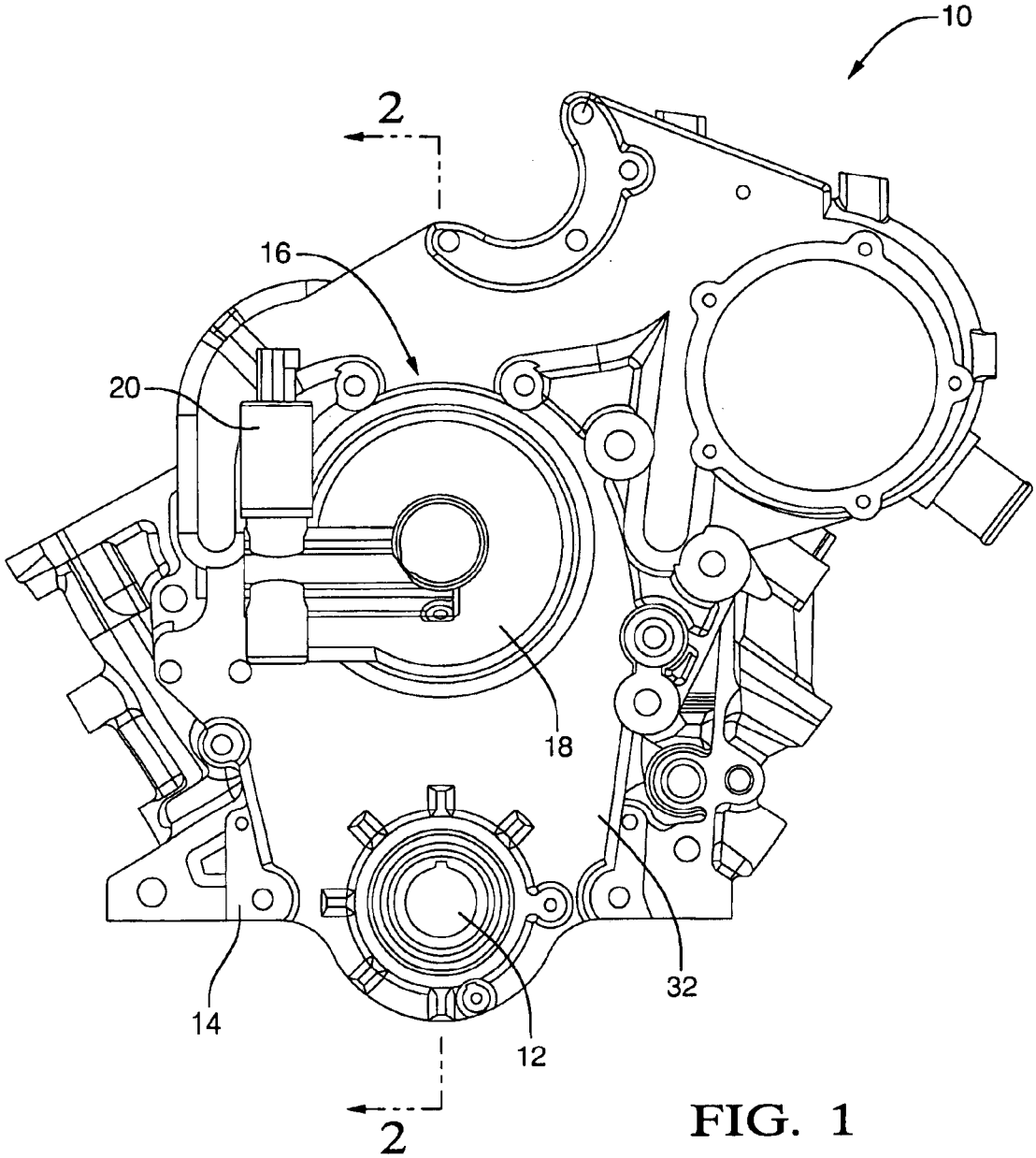
FIG. 1 is a front elevational view of a partially assembled internal combustion engine, showing location of a camshaft phaser in accordance with the invention.

Referring to FIGS. 1 through 5, a partially-assembled internal combustion engine, shown generally as item 10, includes a crankshaft 12 disposed conventionally on block 14. A first embodiment 16 of a vane-type camshaft phaser in accordance with the invention is disposed on the front of engine 10 and includes an outer cover 18 supporting and cooperating with an oil control valve 20 for controlling oil flow into and out of the phaser. Valve 20 receives pressurized oil from an oil gallery 22 in the engine block, as described below, and selectively distributes oil to timing advance and retard chambers within phaser 16, also as described below, to controllably vary the phase relationship between the engine'S camshaft 24 and crankshaft 12 as is known in the prior art.

Camshaft 24 is supported in a camshaft bearing 26 and is hollow at the outer end and threaded conventionally for receiving a phaser attachment bolt 28. Bearing 26 is modified from standard to extend forward of the end of camshaft 24 for rotatably supporting on an outer surface 27 thereof a camshaft pulley or sprocket 30 connected in known fashion via a timing belt or chain (not shown) to a smaller pulley or sprocket (not shown) mounted on the outer end of crankshaft 12. The two sprockets and timing chain are enclosed by a timing chain cover 32 mounted to engine block 14.

Phaser 16 includes a stator 34 fixedly mounted to sprocket 30 for rotation therewith and an inner cover plate 36 conventionally attached to stator 34 and sprocket 30 via shouldered bolts 31. Stator 34 is formed having a plurality of spaced-apart inwardly-extending lobes 38. Between sprocket 30, stator 34, and plate 36 is a rotor chamber 35 containing a rotor 40 having a hub 41 and a plurality of outwardly-extending vanes 42 interspersed between lobes 38 to form a plurality of opposing advance and retard chambers 44,46 therebetween. This arrangement is well known in the prior art of vane-type camshaft phasers and need not be further elaborated here.

Figure 5:
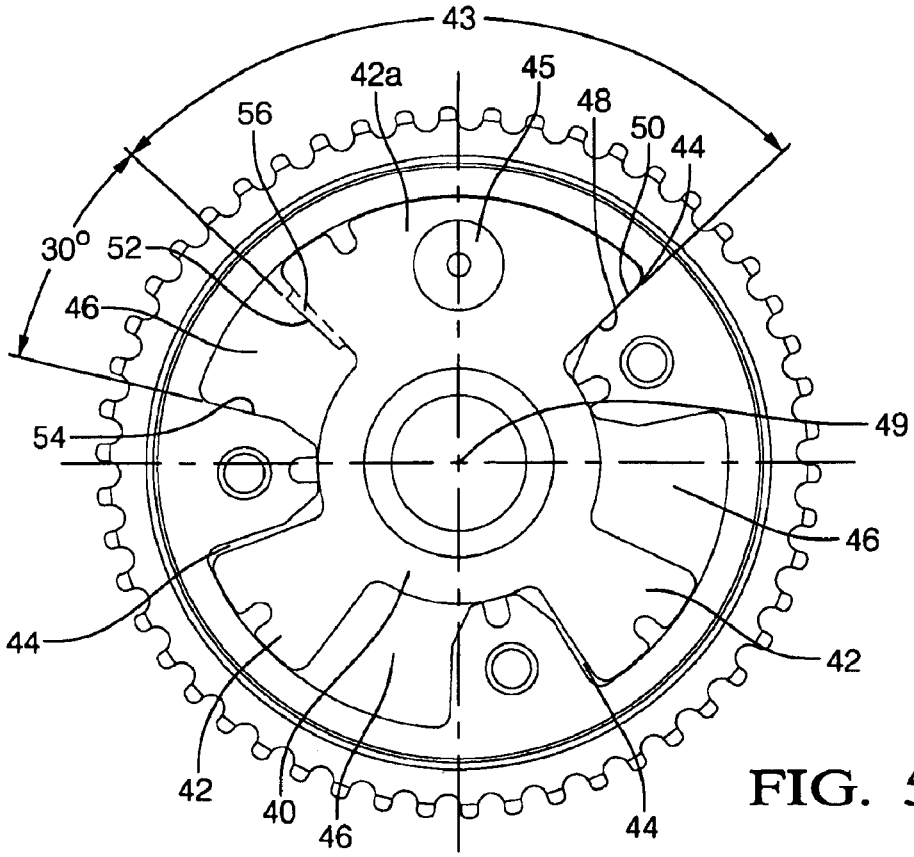
FIG. 5 is a plan view of the camshaft phaser partially assembled, showing the sprocket, stator, and rotor.
Figure 6:
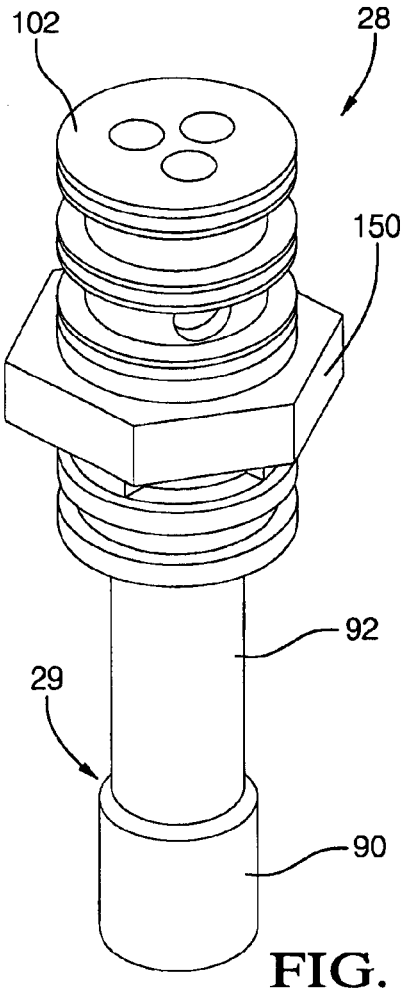
FIG. 6 is an isometric view of a combination attachment bolt and oil conduit element for the camshaft phaser shown in FIG. 3.
Figure 7:
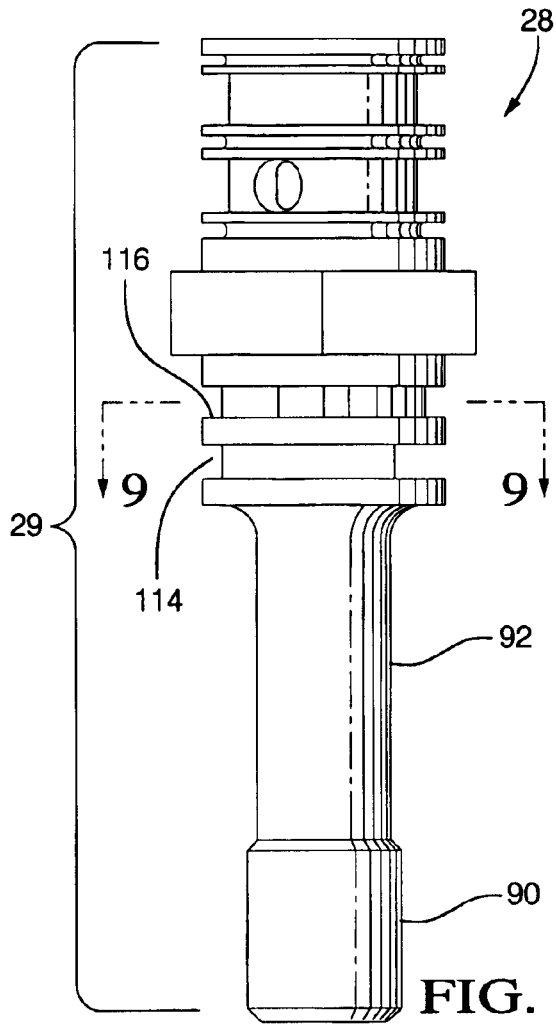
FIG. 7 is an elevational view of the bolt shown in FIGS. 3 and 6.

A currently-preferred phaser embodiment 16 comprises three stator lobes and three rotor vanes. The lobes are arranged asymmetrically about axis 49 as shown in FIG. 5, permitting use of a vane 42*a* extending over a much larger internal angle 43 than the other two vanes 42. Vane 42*a* is thus able to accommodate a locking pin mechanism 45 as described more fully below. Further, a first surface 48 of large vane 42*a* engages a lobe surface 50 at one extreme rotor rotation, as shown in FIG. 5, and a second surface 52 of large vane 42*a* engages a lobe surface 54 at the opposite extreme of rotation. Either or both surfaces 48,52 may be equipped with hardened wear pads 56. Alternately, either or both lobe surfaces 50,54 of stator 34 may be equipped with hardened wear pads 56.

Only the wide rotor vane 42*a* actually touches the stator lobes; the other vanes and lobes have extra clearance to prevent contact regardless of rotor position. The wide angle vane 42*a* is stronger than the other two narrower vanes 42 and thus is better able to sustain the shock of impact when a vane strikes a lobe in an uncontrolled event such as at engine start-up. The rotor displacement angle, preferably about 30° as shown in FIG. 5, may be limited and calibrated by secondary machining operations on the stator lobe and/or rotor vane contact surfaces.

Referring to FIGS. 2 through 5, locking pin mechanism 45 is disposed in a bore 60 in rotor vane 42*a* for controllably engaging a well 62 in sprocket 30 as desired to rotationally lock the rotor and stator together. Mechanism 45 comprises a lock pin sleeve 64 disposed in bore 60 and extending from vane 42*a* through an arcuate slot 66 in inner cover plate 36. Sleeve 64 terminates in an enlarged head 67 for retaining an external bias spring 68, as is described more fully below. Preferably, slot 66 includes a portion 70 wide enough to permit passage of head 67 through the slot during assembly of the phaser. Slot 66 extends through a central arc at least equal to the actuation arc of the rotor within the stator, preferably about 30° as noted above. Vane 42*a* is of sufficient angular width such that the advance and retard chambers adjacent thereto are not exposed to slot 66 even at the extremes of rotor rotation. An outside surface 37 of inner plate 36 may be optionally equipped with supporting flanges 69. Flanges 69 serve to provide support to spring 68, during phaser operation, so that the torque applied to the rotor by the spring through its operational range is repeatable and as designed. Also, centering of spring body 68*a* by flanges 69 relative to the center of rotation of the cam phaser helps to balance the phaser during high rotational speeds. In addition, flanges 69 serve to stiffen cover plate 36 to improve sealability of the phaser against oil leakage.

Slidingly disposed within an axial bore 71 in sleeve 64 is a lock pin 72 having a locking head portion 74 for engaging well 62 and a tail portion 76 extending through sleeve head 67. Lock pin 72 is single-acting within bore 71. A compression spring 78 within bore 71 urges pin 72 into lock relationship with well 62 whenever they are rotationally aligned. A groove 80 in sprocket 30 (FIG. 3) connects well 62 with a retard chamber 46 in the assembled phaser such that oil pressure applied to the retard chambers overcomes spring 78 to retract pin 72 into bore 71, unlocking the rotor from the stator.

Figure 4:
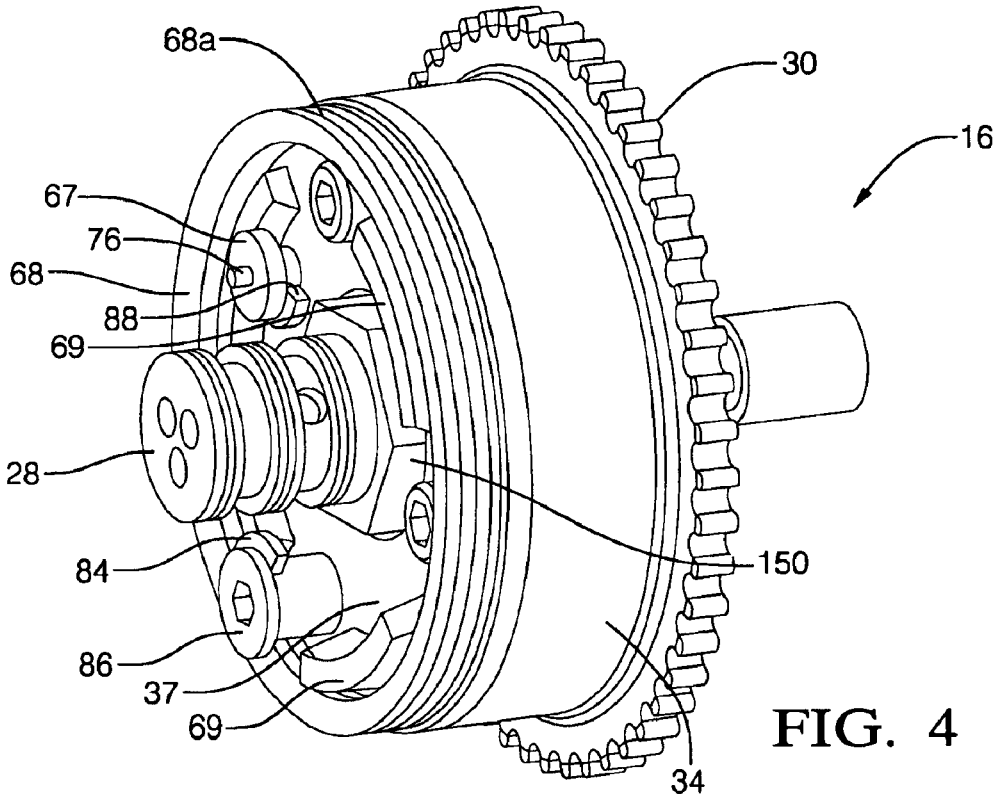
FIG. 4 is an assembled isometric view of the camshaft phaser shown in FIG. 3, the cover and oil control valve being omitted for clarity.

An advantage of the present locking pin mechanism is that tail portion 76 extends beyond cover plate 36 and head 67 (FIG. 4). This feature permits the lock pin to be manually retracted by an operator by grasping tail portion 76 while the phaser is being installed or removed from the engine, thus preventing damage from high torque exerted via cam attachment bolt 28 in bolting the phaser to the engine. Tail portion 76 can also be used to detect whether lock pin 72 is engaged in well 62 while the engine is operating such as, for example, by the use of a Hall Effect sensor.

Figure 2:
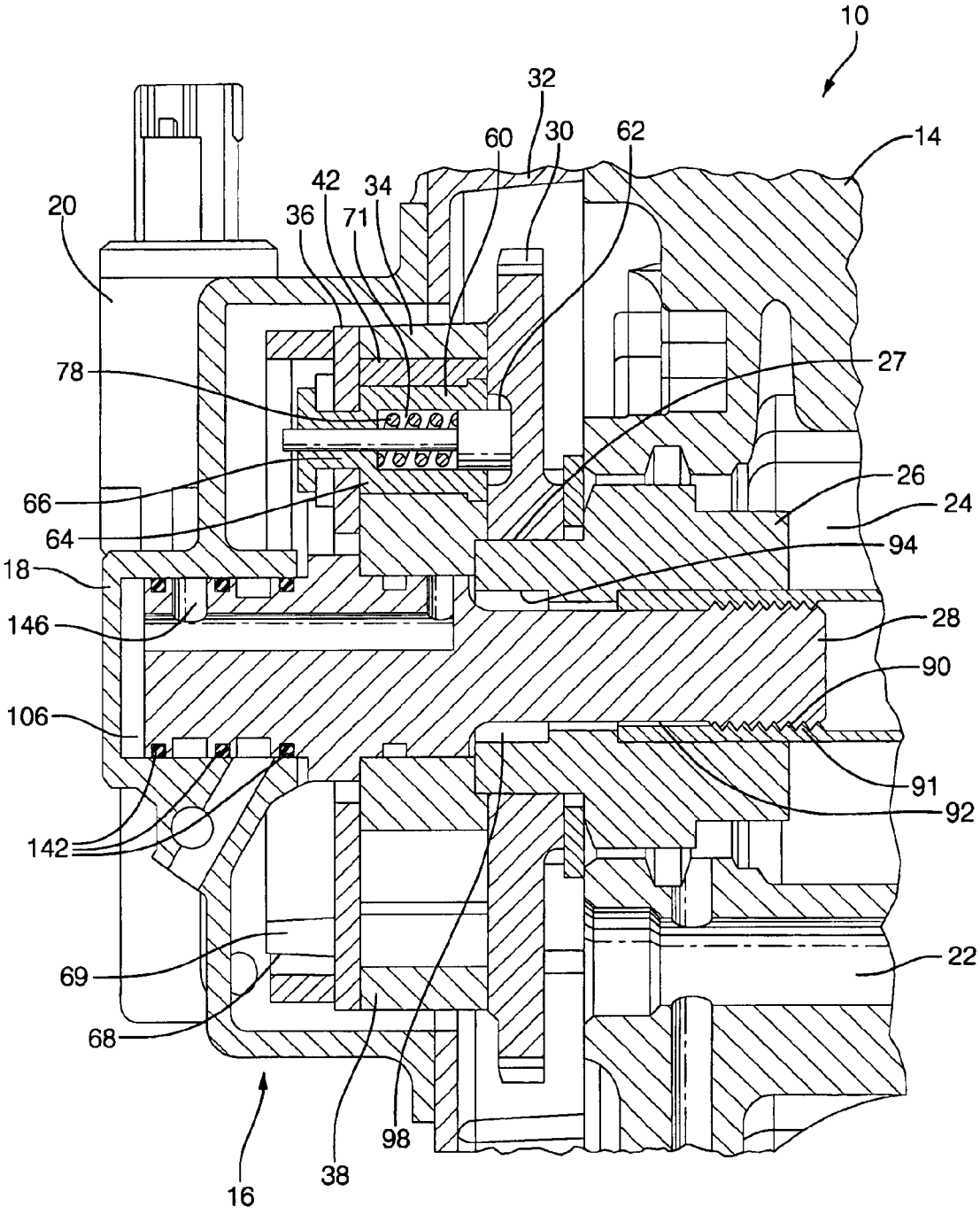
FIG. 2 is a portion of an elevational cross-sectional view through the engine shown in FIG. 1, taken along line 2—2 therein.
Figure 3:
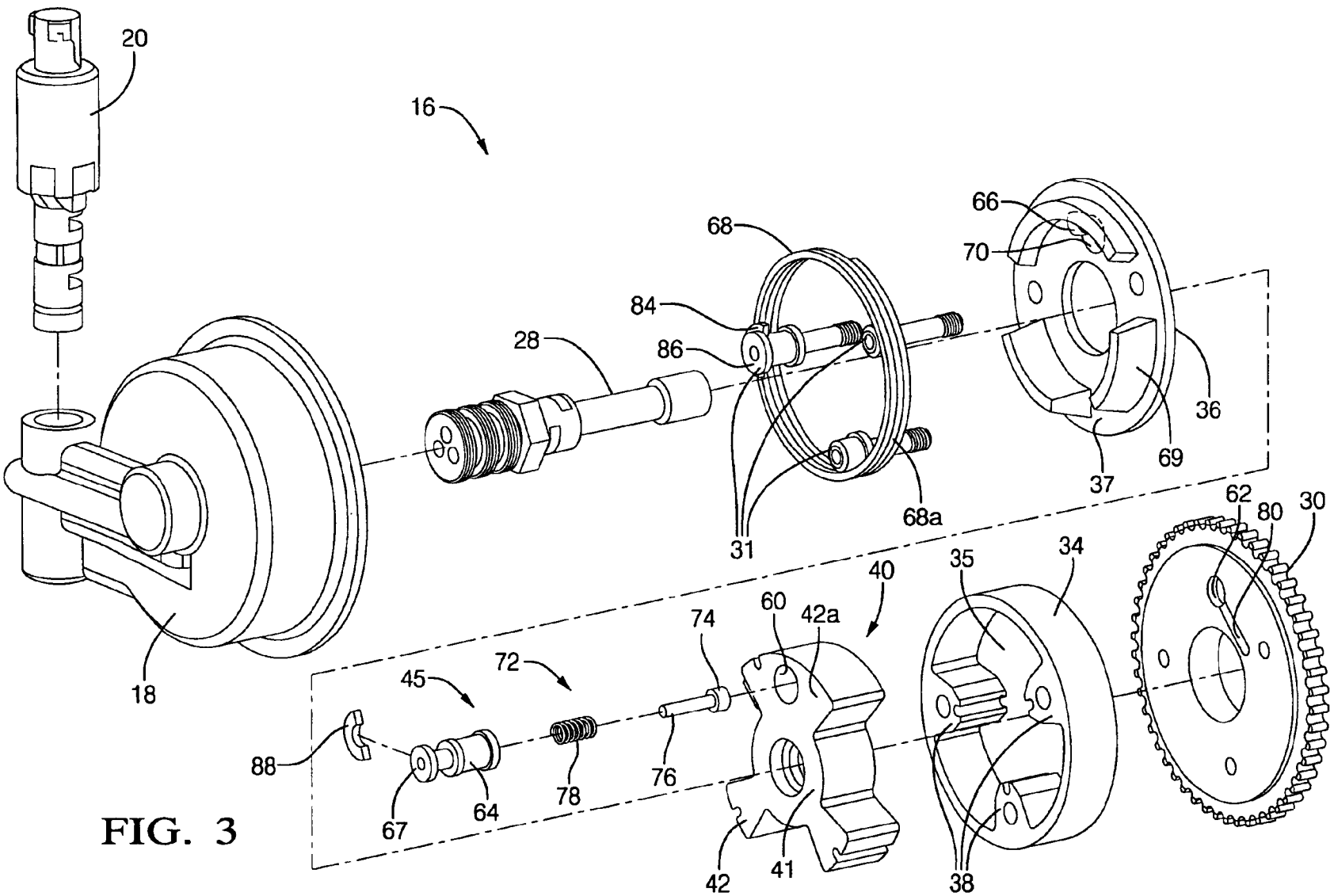
FIG. 3 is an exploded isometric view of a first embodiment of a vane-type camshaft phaser in accordance with the invention.

Referring to FIGS. 2 through 4, a first embodiment of a torsion mechanism 58 is shown, including a multiple-turn torsion bias spring 68 disposed on the outer surface 37 of cover plate 36. A first inwardly-extending tang 84, formed as a soft radiused hook, is engaged with a mandrel end 86 of a shouldered bolt 31 as a fixed spring stop, and a second inwardly-extending tang 88, also formed as a soft radiused hook, is engaged with head 67 of locking pin assembly 45 as a rotary spring stop. The spring is pre-stressed during phaser assembly such that the locking pin assembly, and hence rotor 40, is biased at its rest state to the fully retarded position shown in FIG. 5. Prior art phasers are known to employ a bias spring within the rotor chamber, but assembly of such an arrangement is difficult and prone to error, and the spring diameter typically is limited to the diameter of the rotor hub. The external spring in accordance with the invention is without high stressed bends and is easy to install. Moreover, correct installation is easily verified visually, and the spring diameter can be greater than the rotor hub diameter by proper placement of the locking pin assembly in the rotor vane.

Referring to FIGS. 2 through 11, phaser attachment bolt 28 serves the added purpose of providing passages for oil to flow from engine gallery 22 via bearing 26 to oil control valve 20 and from control valve 20 to advance and retard chambers 44,46.

Figure 8:
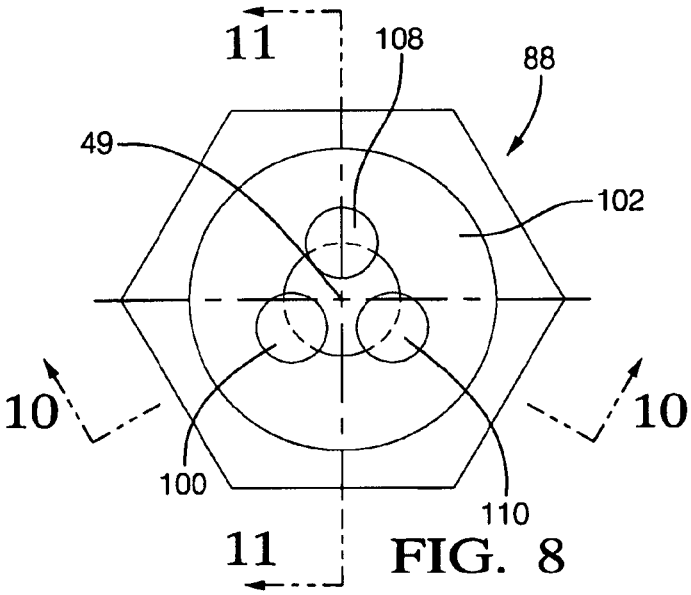
FIG. 8 is a top view of the bolt shown in FIGS. 3 and 6, showing the relationship of various oil passages therein.
Figure 9:
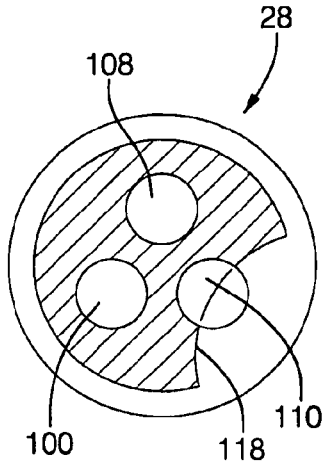
FIG. 9 is a cross-sectional view taken along line 9—9 in FIG. 7, showing access to one of the oil passages.
Figure 10:
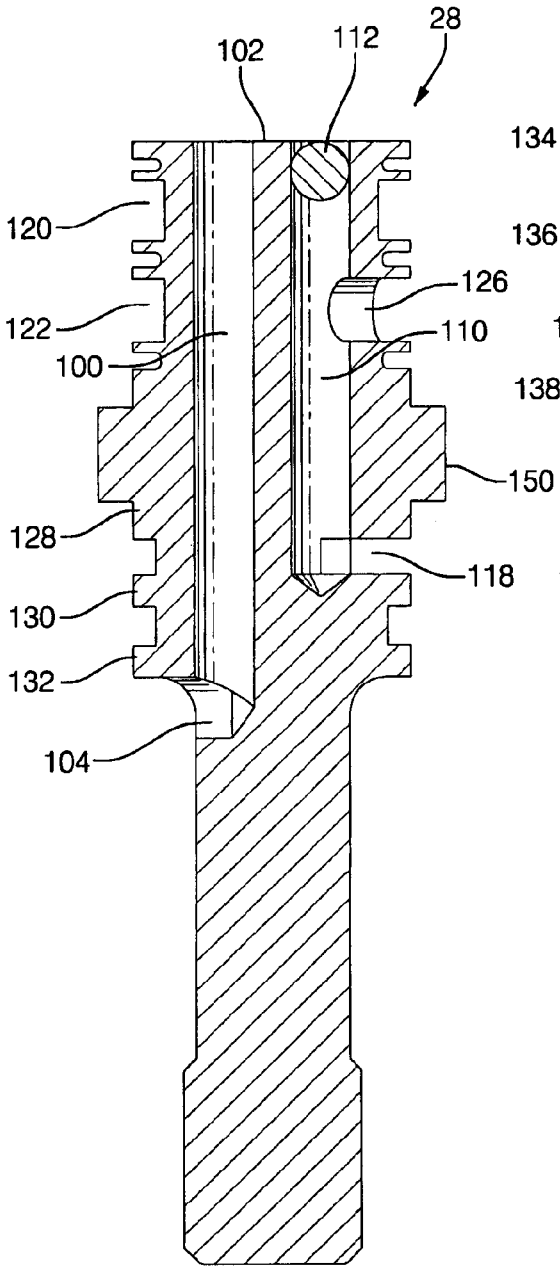
FIG. 10 is a broken cross-sectional view of the bolt taken along line 10—10 in FIG. 8.
Figure 11:
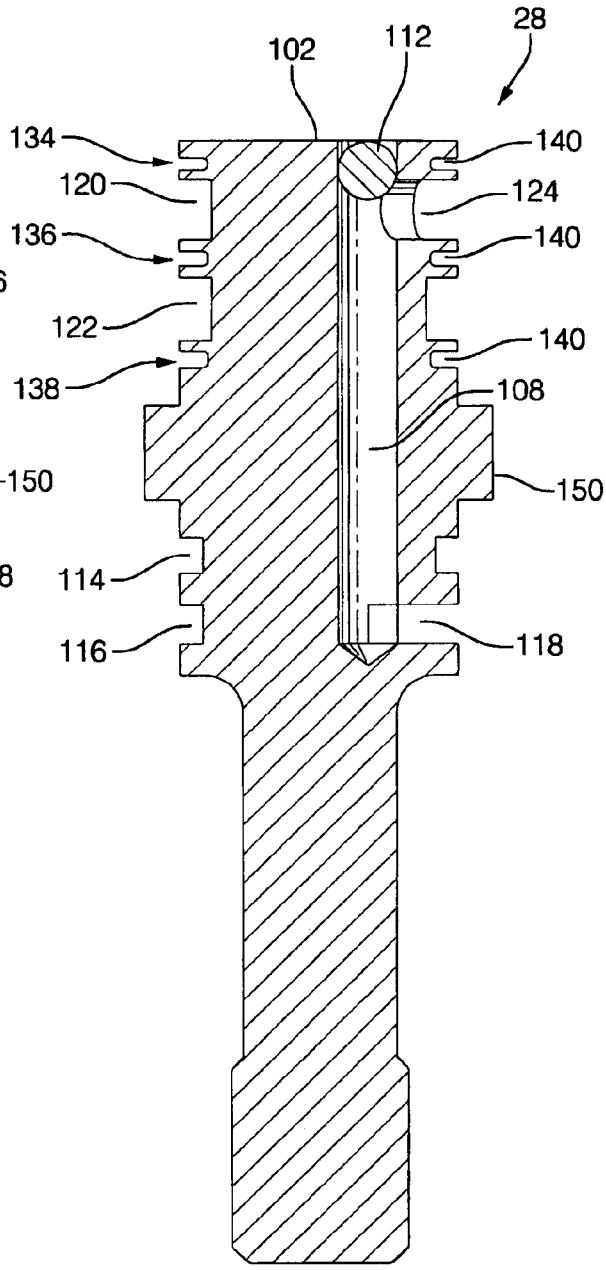
FIG. 11 is a cross-sectional view of the bolt taken along line 11—11 in FIG. 8.
Figure 12:
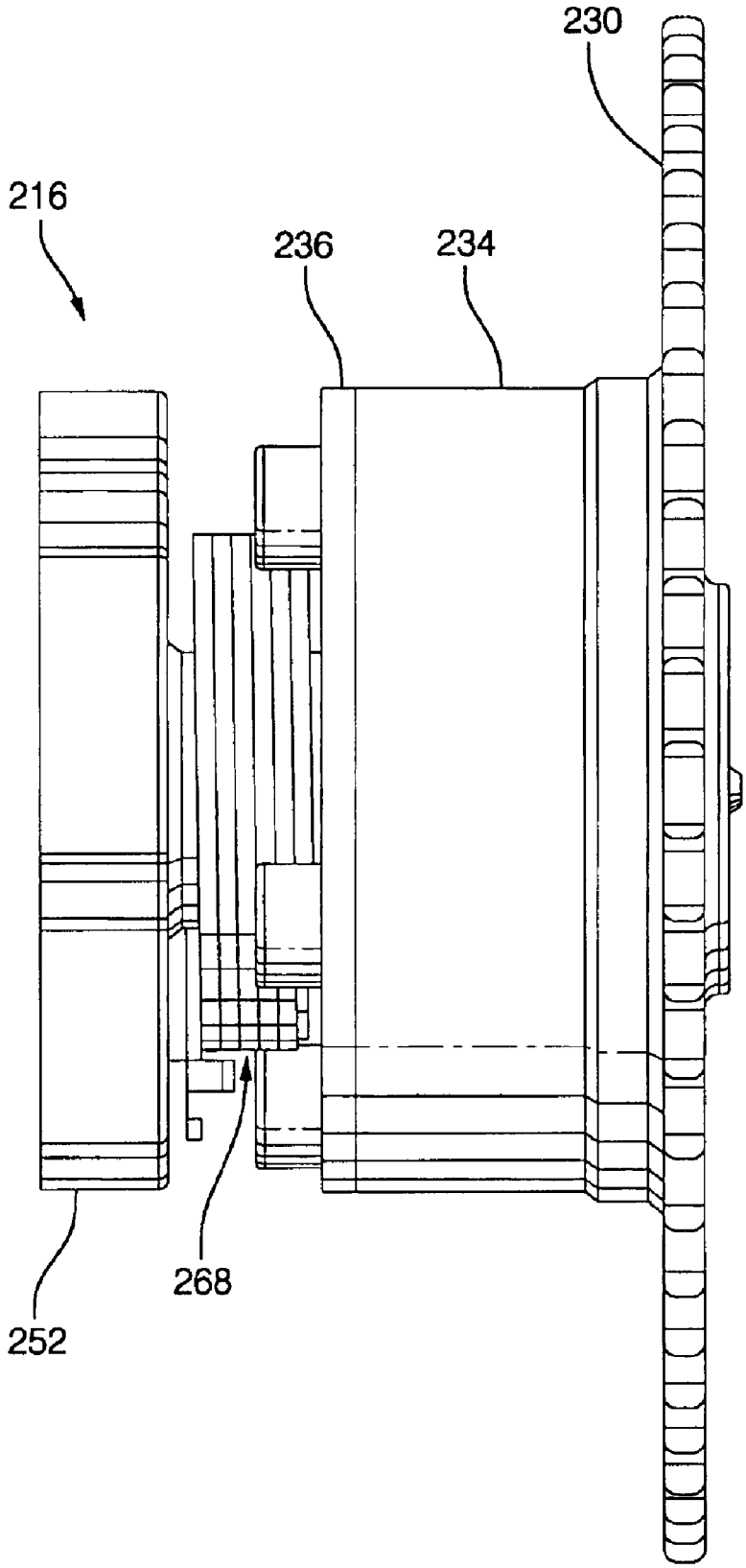
FIG. 12 is an elevational view of a second embodiment of a vane-type camshaft phaser in accordance with the invention.
Figure 13A:
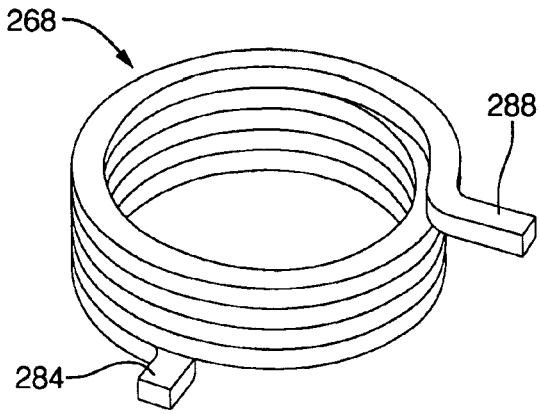
FIGS. 13*a*–13*d* are isometric views of four embodiments of coil springs for use with phasers in accordance with the invention.
Figure 13B:
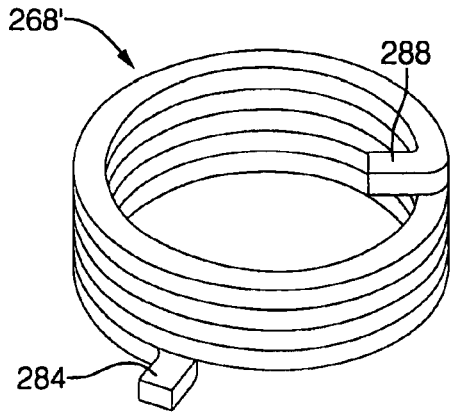
Figure 13C:
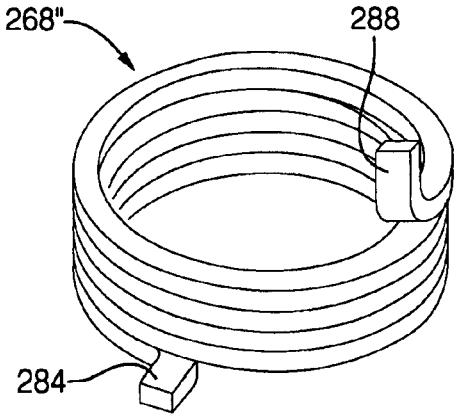
Figure 13D:
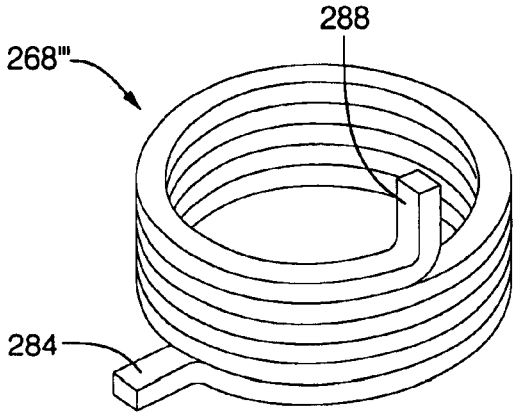

Bolt 28 has a bolt body 29 having a threaded portion 90 for engaging threaded end 91 of camshaft 24 as described above and a necked portion 92 cooperative with bore 94 in bearing 26 to form a first intermediate oil reservoir 98 in communication with gallery 22 via a passage (not shown) through bearing 26. A first longitudinal passage 100 in bolt 28 is formed as by drilling from bolt outer end 102 and extends internally to proximity with necked portion 92. An opening 104 connects passage 100 with reservoir 98. Oil is thus admitted via elements 104,100,102 to a second intermediate reservoir 106 (FIG. 2) formed between outer cover 18 and bolt outer end 102 from whence oil is supplied to control valve 20 via a passage (not shown) formed in outer cover 18. In a currently preferred embodiment, a check valve such as, for example, a ball check or a flapper valve, is disposed in the oil supply passage leading to the oil control valve to enhance the overall phaser system stiffness and response rate. Second and third longitudinal passages 108,110 in bolt 28 are formed as by drilling from outer end 102, then are plugged as by a press-fit ball 112 or other means to prevent entrance of oil from reservoir 106. The three passages preferably are angularly disposed symmetrically about bolt and phaser axis 49 as shown in FIG. 8. Passages 108,110 are each drilled to a predetermined depth proximate to respective inner annular oil supply grooves 114,116 formed in the surface of bolt 28 for mating with an advance or retard oil channel (not shown) in the phaser rotor; then, each passage is opened to its respective annular oil supply groove preferably by removal of an arcuate bolt section 118, as shown in FIGS. 9 through 11. Further, outer annular oil supply grooves mate with control passages (not shown) in the cam cover 18. Each longitudinal passage 108,110 is opened to its respective outer annular oil supply groove 120,122 by drilling radial connecting bores 124,126, respectively.

Lands 128,130,132 prevent leakage from inner grooves 114,116 by being machined to have a close fit within the rotor bore. Because in operation of the phaser the bolt turns with the rotor, no special seals are required. However, because the bolt rotates within cover 18, special seals are necessary for outer annular grooves 120,122. Preferably, outer lands 134,136,138 each comprise twin lands separated by a narrow annular groove 140, each groove being provided with a metal seal ring 142 which is compressed radially into the cover bore 146 and thus is fixed with the cover and does not turn with the bolt.

Bolt 28 is further provided with means for installing the bolt into the camshaft, preferably a wrenching feature. For example, a hexagonal socket (not shown) may be formed in end surface 102 or preferably an external hexagonal feature 150 is formed into the middle region of bolt 28, which feature may be easily wrenched during phaser assembly by an appropriately deep socket wrench.

Thus, when the phaser is fully assembled and installed onto an engine, oil is provided from oil gallery 22 to control valve 20 via first passage 100 and from valve 20 to advance and retard chambers in the phaser via second and third passages 108,110. No modification is required of the engine block or camshaft in order to fit the present phaser to an engine.

Referring to FIGS. 12 through 16, cam phaser 216, including a second embodiment of a torsion mechanism 258 is shown. Phaser 216, in accordance with the invention, may be directly substituted for phaser 16 on engine 10 in FIG. 1. Phaser 216 is functionally similar to phaser 16 and shares many structural components. A stator 234 is mounted to a drive means such as, for example, a sprocket 230, and a rotor 240 is disposed conventionally within the stator. A cover plate 236 closes the rotor chamber, and bolts having heads 231 extend through the cover plate and stator to assemble conventionally the stator and rotor to the sprocket wheel. Cover plate 236 may be formed inexpensively by stamping from sheet stock, and is provided with a central opening 237.

Rotor 240 is preferably although not necessarily provided with a central well 242 extending into the hub thereof for receiving a target wheel element 244 that extends axially inwards through opening 237 into well 242. Element 244 may be, for example, a target wheel unit 246 or an adaptor 248 for supporting a separate target wheel 250. Target wheel 250 may be formed inexpensively by stamping from sheet stock. Target wheels are well known elements in monitoring angular relationships of rotating apparatus. A central mounting bolt 228 extends through a central bore 232 in unit 246 or adaptor 248 for securing the phaser assembly to the engine camshaft 24 (FIG. 2). Either unit 246 or adaptor 248 may be formed as by machining from a blank or sintering of powdered metal in a mold in known fashion. The target wheel may include a rim portion 252 that is turned away from (FIG. 14) or toward (FIG. 15) the phaser assembly.

FIGS. 13*a* through 13*d* illustrate four exemplary coil springs 268,268',268",268'" for use with phasers in accordance with the invention. Other coil springs, including spiral-wound springs, as may be suggested to those skilled in the art, are fully comprehended by the invention. Such springs may be wound clockwise (CW) or counterclockwise (CCW) depending upon the application requirements and may have tangs extending radially inwards, radially outwards, or axially of the coils.

Figure 14:
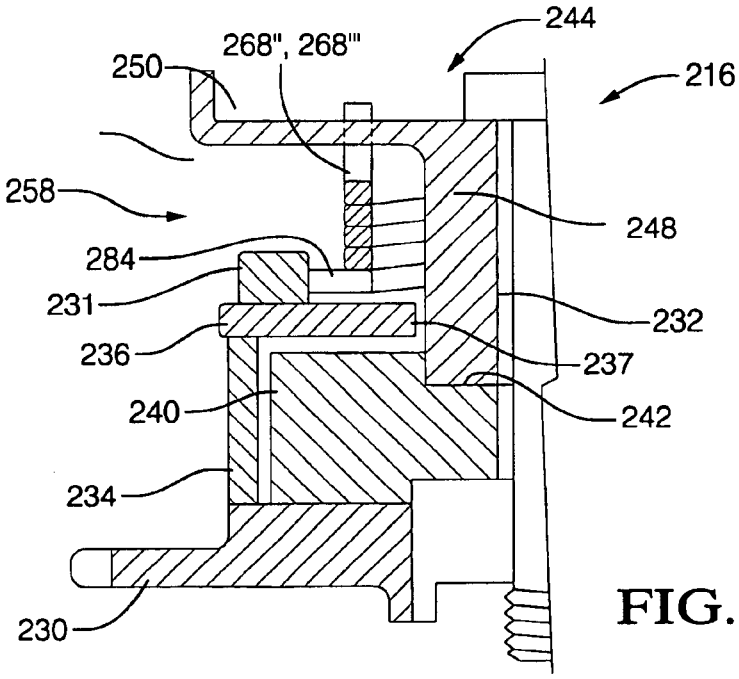
FIG. 14 is a half elevational cross-sectional view of the phaser shown in FIG. 12.
Figure 15:
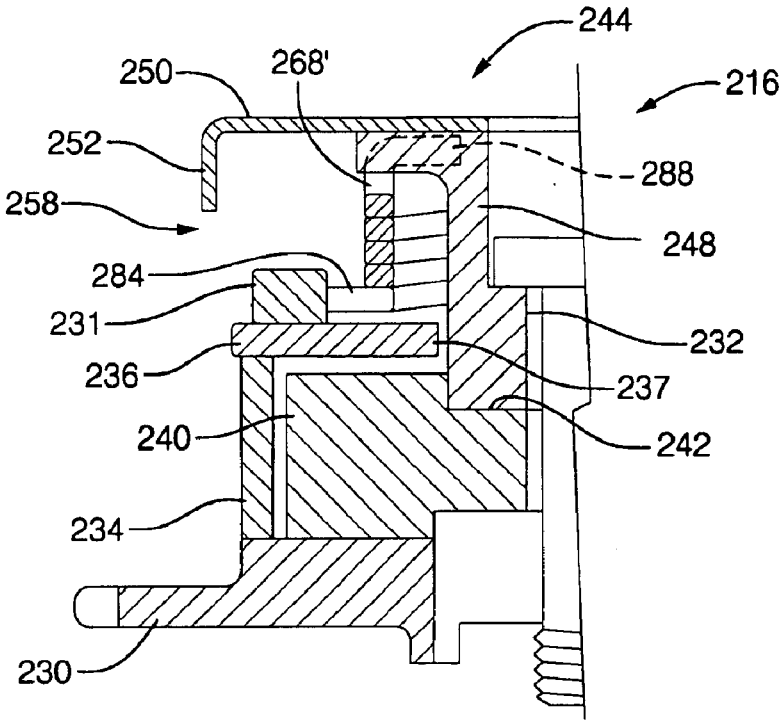
FIG. 15 is a half elevational cross-sectional view of an embodiment alternative to that shown in FIG. 14.
Figure 16:
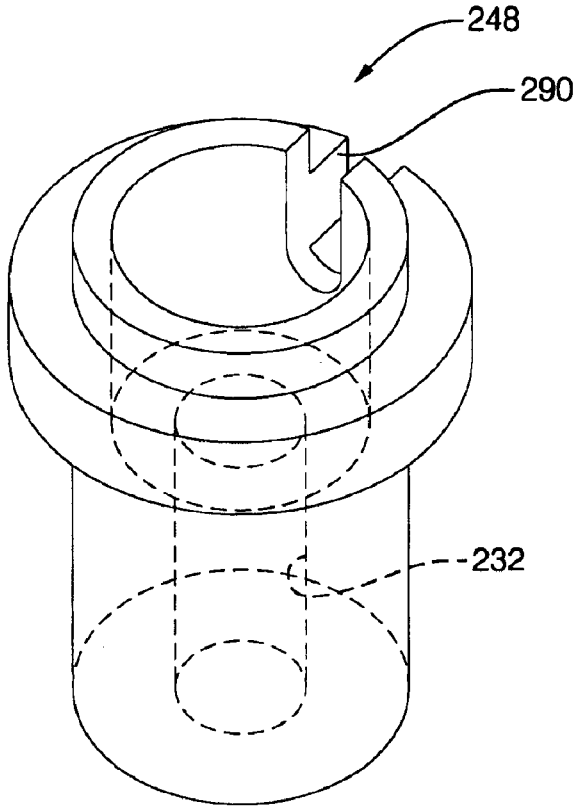
FIG. 16 is an isometric view of a rotor insert for use in the phaser embodiment shown in FIG. 15.

Spring 268 (FIG. 13*a*) is a CCW spring having first and second tangs 284,288 both extending radially outwards. Spring 268' (FIG. 13*b*) is a CCW spring having first tang 284 extending outwards and second tang 288 extending inwards. Spring 268" (FIG. 13*c*) is a CCW spring having first tang 284 extending outwards and second tang 288 extending axially. Spring 268'" (FIG. 13*c*) is a CW spring having first tang 284 extending outwards and second tang 288 extending axially. Either of springs 268" or 268'", having an axially-extending second tang 288, are suitable for use with the target wheel unit 246 as shown in FIG. 14. Spring 268' is especially suitable for use with adapter 248 wherein a radial slot 290 is receivable of inwardly-extending second tang 288. Adapter 248 preferably is keyed or otherwise provided means for achieving a predetermined and fixed angular orientation to rotor 240.

In all embodiments shown, the external bias spring is anchored by first tang 284 against a bolt head 231.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A torsion mechanism for rotationally biasing a rotor in a rotor chamber of a camshaft phaser, the chamber being formed by a sprocket, a stator, and a cover plate, the mechanism comprising:

a) a torsion spring disposed outside said rotor chamber and having first and second tangs at opposite ends thereof;

b) fixed means for rotationally anchoring said first spring tang with respect to said stator and said cover plate; and c) means connected to said rotor and extending through an opening in said cover plate for rotationally anchoring said second spring tang to said rotor.

2. A mechanism in accordance with claim 1 wherein said torsion spring is a multiple-turn coil spring.

3. A mechanism in accordance with claim 1 wherein said fixed anchoring means includes a bolt connecting said cover plate and said stator to said sprocket.

4. A mechanism in accordance with claim 1 wherein said means connected to said rotor includes a locking pin mechanism.

5. A mechanism in accordance with claim 1 wherein said means connected to said rotor extends from a vane of said rotor.

6. A mechanism in accordance with claim 1 wherein said means connected to said rotor includes a target wheel unit.

7. A mechanism in accordance with claim 1 wherein said means connected to said rotor is disposed in and extends from a central well in said rotor.

8. A mechanism in accordance with claim 1 wherein the diameter of said torsion spring is greater than the diameter of a hub of said rotor.

9. A mechanism in accordance with claim 1 wherein said opening is an arcuate slot, and wherein said arcuate slot subtends a central angle equal to the maximum rotational angle of said rotor within said stator.

10. A vane-type camshaft phaser, comprising a torsion mechanism for rotationally biasing a rotor in said phaser, said phaser including a rotor chamber formed by a sprocket, a stator, and a cover plate, said torsion mechanism including a torsion spring disposed outside said rotor chamber and having first and second tangs at opposite ends thereof, fixed means for rotationally anchoring said first spring tang with respect to said stator and said cover plate, and means connected to said rotor and extending through an opening in said cover plate for rotationally anchoring said second spring tang to said rotor.

* * * * *